United States Patent [19]

Case et al.

[11] 4,056,912

[45] Nov. 8, 1977

[54] METHOD FOR RELEASING TILT-UP PANEL HOISTING MEMBER

[75] Inventors: James E. Case; Richard L. Ruppert, both of Sparks, Nev.

[73] Assignee: The Dayton Sure-Grip & Shore Company, Miamisburg, Ohio

[21] Appl. No.: 751,536

[22] Filed: Dec. 16, 1976

Related U.S. Application Data

[62] Division of Ser. No. 578,552, May 19, 1975, Pat. No. 3,997,959.

[51] Int. Cl.[2] ..... E04B 1/00; E02D 35/00; E04H 12/20

[52] U.S. Cl. ..... 52/745; 52/127; 85/1 H; 294/102; 214/1 H

[58] Field of Search ..... 52/741, 745, 749, 122, 52/126, 127, 125; 85/32 CS, 1, 64; 214/1 H, 130; 294/19 R, 102; 29/244; 254/18

[56] References Cited

U.S. PATENT DOCUMENTS

| | | | |
|---|---|---|---|
| 1,798,456 | 3/1931 | Carroll | 214/1 H |
| 2,859,884 | 11/1958 | Pearce | 214/1 H |
| 3,152,375 | 10/1964 | Blakeley | 85/64 |
| 3,456,547 | 7/1969 | Strong | 294/102 R |
| 3,798,856 | 3/1974 | Gloskowski | 52/745 |
| 3,997,959 | 12/1976 | Case et al. | 214/1 H X |

*Primary Examiner*—J. Karl Bell

*Attorney, Agent, or Firm*—Biebel, French & Nauman

[57] ABSTRACT

Tilt-up building wall panels are fitted with inserts which are cast into the panel. The inserts have threaded openings into which a collapsible split bolt is inserted. The bolt is spread apart with a longitudinally inserted wedge to secure its exterior thread to the interior thread of the insert. The panel is erected into its upright position with suitable hoisting equipment engaging the protruding portion of the split bolt. The split bolt and the hoisting equipment are removed from the ground with a ground release device that is raised overhead with extensions attached to the release device. The release device includes a support structure which has a flat end face that is positioned against the side of the upright panel and a linearly reciprocating release plate mounted to the support structure. The operator positions the release device so that the release plate engages a portion of the wedge and he then retracts the plate by pulling a suitably connected actuating cable from the ground. The retraction of the release plate pulls with it the wedge so that the split bolt can be collapsed and axially withdrawn from the threaded opening. The release device includes means for biasing the release plate to its position proximate the flat end face of the support structure and it is further fitted with means preventing hardware withdrawn from the threaded opening from dropping to the ground.

7 Claims, 6 Drawing Figures

METHOD FOR RELEASING TILT-UP PANEL HOISTING MEMBER

REFERENCE TO RELATED APPLICATION

The present application is a division of application Ser. No. 578,552, filed May 19, 1975 now U.S. Pat. No. 3,997,959.

BACKGROUND OF THE INVENTION

The present invention relates to means for removing from upright, tilt-up building panels the lifting devices used for erecting the panel without requiring a workman to climb to the height at which the lifting device is attached to the panel.

Tilt-up building panels or slabs are increasingly used in the construction of large buildings, usually commercial or industrial buildings. In such constructions concrete panels are formed on the floor of the building or on a level ground surface, they are then lifted to a vertical or upright position and interconnected to form the walls of the building.

The lifting device for each panel must be removed after the panel is in place. Since the lifting device is normally attached at a substantial height, the panels ranging in height to up to thirty feet or more, it was heretofore necessary that a workman position a ladder against a panel and that he climb up a ladder so that he can reach the lifting device and disconnect it. To facilitate this task, a quick-release connector has heretofore been devised for coupling the hoisting device, e.g., the crane hook to the panel. This connector is described and claimed in U.S. Pat. No. 3,456,547.

Briefly, the quick release connector described in that patent comprises an insert that is cast into the panel and which comprises an internally threaded nut the opening of which is flush with the side of the panel. The threaded opening is engaged with a split bolt formed of a pair of separate longitudinal bolt segments which can be brought together or collapsed sufficiently so that the segments can be axially inserted into the threaded opening of the insert without contacting the insert. Thus, the segments can be linearly inserted and need not be threaded into the insert. After the bolt segments are inserted a wedge or spreader is placed between them to expand them into engagement with internal threads of the insert. This expansion locks the split bolt to the insert. To remove the split bolt the wedge is axially withdrawn and the two bolt segments are brought together again to disengage them from the insert. Thereafter the bolt segments can be axially withdrawn from the opening.

When the split bolt is inserted, a portion of its shank protrudes past the insert and engages a collar or a similar structural member which includes an eyelet, a ring or the like to which the crane hook or similar panel lifting device is releasably attached.

Although the above described split bolt for releasably securing the lifting device to building panels is a great improvement over the prior art and substantially reduces the time required for attaching and releasing the lifting device from the panel, it nevertheless requires that a workman place a ladder against the upright panel to reach and release the split bolt. Since building panels are large and heavy, each panel requires several spaced apart lifting devices. This in turn requires the workmen to reposition the ladder and climb up for the release of each of the split bolts. While he performs this work, the crane or other hoisting equipment, which normally comprises the most expensive (per hour) piece of equipment on a construction job, is idle. Even though only relatively little time may be required to loosen any one split bolt the total time is significant, because there are often hundreds or thousands of inserts on large construction sites from which the lifting devices must be removed. When multiplied by the hourly rate for a crane and its operator, the additional costs are substantial; they often amount to thousands of dollars per site.

In addition, the necessity for placing ladders against upright, tilt-up panels and the need for climbing them represents a safety hazard. Building sites have a traditionally uneven ground which is often cluttered with debris and which is sometimes relatively soft. Thus, unless the ladder is positioned with care and skill its footing might be unstable and might give way under the weight of the workman thereon. At the often substantial heights of twenty, thirty or more feet of such panels, this is dangerous. Moreover, there is the further danger that the temporarily braced panel is insufficiently supported and may fall under the lateral force applied by the ladder positioned thereagainst due to an improperly positioned temporary panel support. This can be fatal not only to the workman on the ladder but to other workmen in the vicinity of the falling panel.

SUMMARY OF THE INVENTION

The present invention is particularly adapted for use in conjunction with the quick-release connector for tilt-up panels into place described in the above-discussed U.S. patent. Generally speaking, the invention provides a method for erecting the panel by anchoring the insert (fitted with an internally threaded opening) in the panel so that the opening is flush with the side of the panel and extends perpendicular thereto. A split bolt defined by a plurality of cooperating bolt segments and having an exterior thread complementary to that of the threaded opening is inserted in the opening in its collapsed form, that is when the segments are brought together and proximate to each other. The segments are then spread apart with an axially inserted wedge to engage the threads and lock the bolt to the insert. After the panel has been raised into its upright position and suitably braced, the split bolt is withdrawn from the ground by positioning a linearly reciprocable release member in substantial alignment with the bolt and engaging the wedge with the release member. The release member is pulled away from the bolt by an operator stationed on the ground to thereby move the wedge out of its engagement with the bolt segments. The bolt segments are then collapsed and axially withdrawn from the threaded opening in the insert.

As is conventional, a suitable means is provided for connecting the split bolt with hoisting equipment, say a crane hook. Such means comprises a flat base plate which embraces a portion of the split bolt protruding from the insert in the tilt-up panel. The base plate in trun mounts a lifting ring or eye which is pivotally connected to the plate and which is engaged by the crane hook. Since the base plate has an aperture through which the split bolt extends, the former is placed over the threaded opening of the insert before the collapsed split bolt is axially inserted therein and expanded with the wedge.

The removal of the split bolt together with the base plate and the lifting eye from the insert is accomplished with a ground release device which linearly reciprocally pulls the wedge from the split bolt until the former is fully withdrawn and the latter can be collapsed. After the collapse of the bolt segments they are also axially withdrawn from the threaded opening in the insert. The removal of the split bolt releases the base plate and the lifting eye for lifting the next panel into its upright position.

The ground release device of the present invention generally comprises a support structure including means for connection to an extension pole so that a workman positioned on the ground proximate the upright tilt-up panel can raise the support structure to the height of the split bolt. The support structure includes a release plate which can be engaged with the portion of the wedge protruding from the split bolt and means for linearly reciprocating the plate over a sufficient distance to completely withdraw the wedge from between the bolt segments.

A flexible cable is connected to the plate to linearly reciprocate the latter from the ground. The support structure is elongate in the direction of the split bolt axis and adjacent its end remote from the panel includes means over which the cable is strung and from which it depends to within grasping reach of the operator. The support structure also includes suitable bearing means for guiding the release plate during reciprocating motions. To prevent hardware such as bolt segments, lifting eyes, base plates and the like from falling to the ground posing a safety hazard the support structure is generally trough-shaped from its flat face rearward and is covered with means such as wire mesh to catch falling hardward while enabling the operator to observe the release of the lifting device through openings in the mesh.

Thus, the present invention enables the removal of the split bolt on tilt-up panels without the need for workmen to place a ladder against the panel and climbing up thereon. Instead the worker, while remaining on the ground, simply raises the support structure to the desired height via lightweight extensions, such as standard aluminum handles used on concrete floats and the like, and places the flat face of the support structure against the panel to steady the ground release device. He then aligns the release plate with the protruding wedge of the split bolt and pushes the ground release upward to engage the wedge with the release plate. Spring means is provided to bias the release plate into its position proximate the panel to facilitate the engagement of the wedge with the plate. Thereafter the operator pulls on the cable to move the release plate away from the panel and the wedge out of its engagement with the bolt segments. When he releases the cable the spring means automatically returns the release plate to its original position.

Thus, the present invention eliminates the heretofore time-consuming positioning, securing and climbing of ladders. Instead, the split bolts can be virtually instantaneously snapped loose with the ground release device. This time required for disconnecting a single lifting device is thereby reduced by a factor of up to 10:1 over what it took to perform this task in the past. The time saved in disconnecting all lifting devices on a given construction site translates into a corresponding reduction of the time during which the expensive crane and its operator are required, and thus, provides savings of thousands of dollars.

In addition to cost savings, the present invention eliminates the safety hazard accompanying the positioning of ladders on the panel. Thus, the present invention assures substantially safer working conditions on tilt-up panel construction sites than was heretofore the case. Yet, the safer working conditions are obtained with a reduction in the cost of erecting the tilt-up panels.

DETAILED DESCRIPTION OF THE PREFERRED EMBODIMENTS

Figure 1:
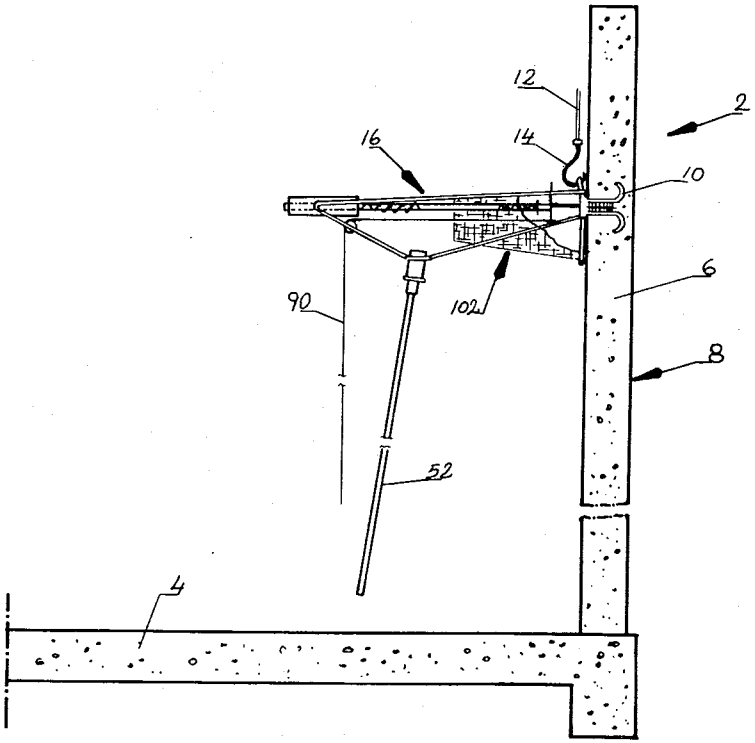
FIG. 1 is a schematic, side elevational view illustrating the manner in which a tilt-up panel lifting device secured to the panel with a collapsible split bolt is removed in accordance with the present invention.

Referring first to FIG. 1, a building 2 is being constructed and generally comprises a floor 4 and a plurality of serially arranged, tilt-up building panels 6 defining a wall 8 of the building. The roof and columns supporting the roof are not shown in the drawing because they have no relationship to the present invention.

As discussed above, the tilt-up panels are formed in their horizontal position (not shown) by pouring concrete into suitable forms (not shown) which may be disposed on building floor 4. Inserts 10 are cast into the forms at strategically located and predetermined points so that the panel, after it has cured, can be lifted with a crane or similar hoisting equipment (not shown) via lifting cables 12 fitted with hooks 14 and depending from a suitable, normally self-equalizing crane rigging (not shown). When the tilt-up panel 6 is in its upright position and properly located between adjoining panels and/or building columns, it is secured. Normally, this involves the application of temporary braces (not shown) and the interconnection of the panels with concrete, mechanical devices, or the like.

As soon as the just erected building panel is braced against falling under its own weight or from minor lateral forces the crane hooks are disconnected from the inserts so that the next panel can be raised. For this purpose, the present invention provides a ground release device 16 which enables the release of the hooks from the inserts even though the inserts may be twenty, thirty or more feet above ground without requiring a workman to climb up a ladder to manually reach the hook.

Figure 3:
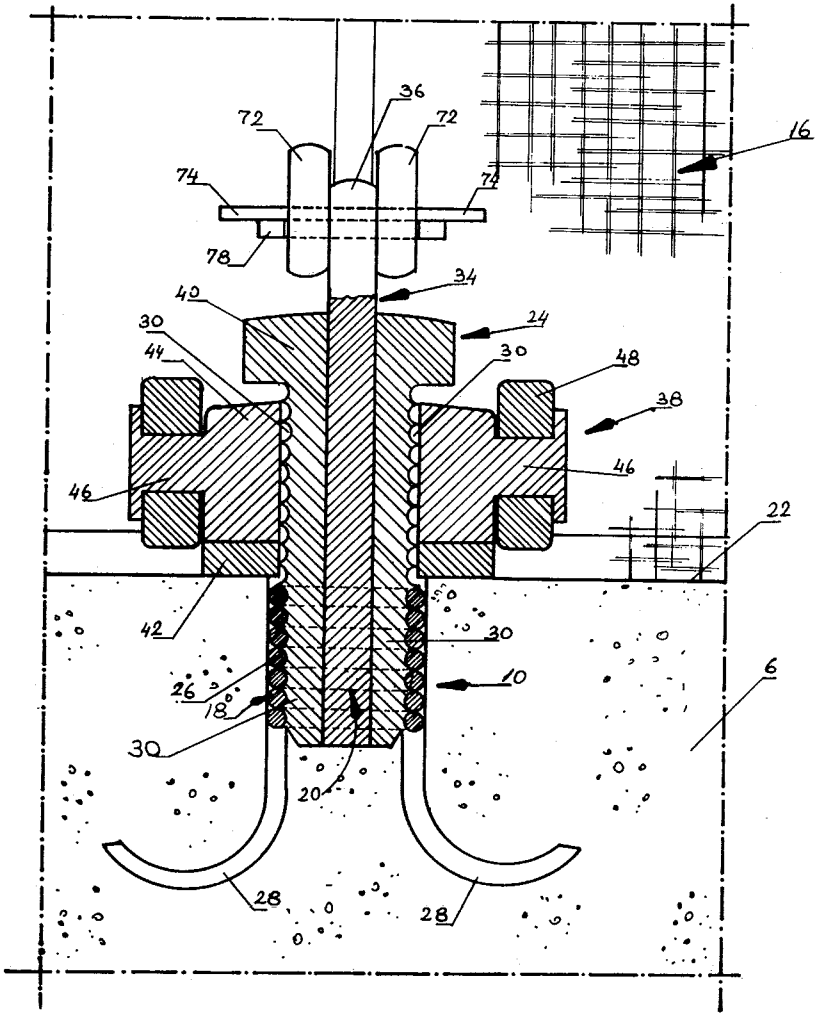
FIG. 3 is an enlarged, fragmentary plan view and is taken on line 3—3 of FIG. 2.
Figure 5:
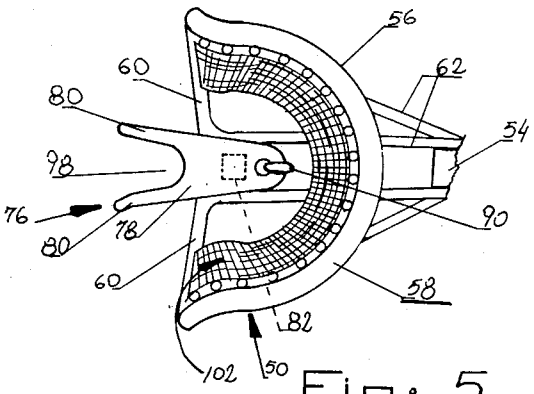
FIG. 5 is an end view of the ground release illustrated in FIGS. 2 and 4.
Figure 6:
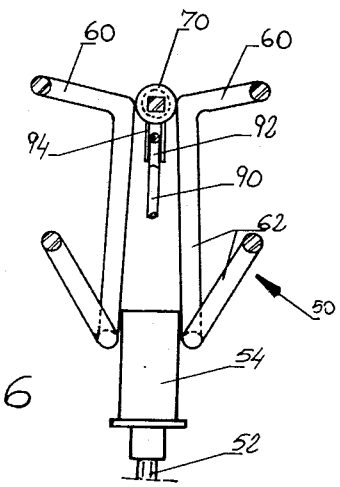
FIG. 6 is a cross-sectional elevational view of the device and is taken on line 6—6 of FIG. 2.
Figure 4:
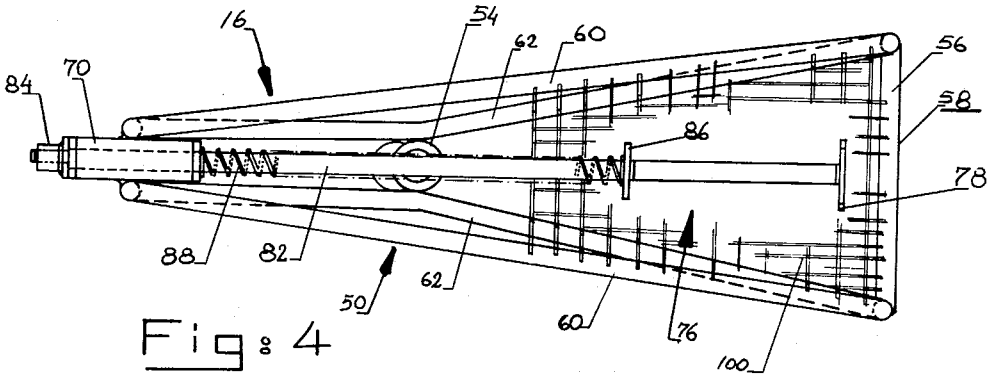
FIG. 4 is a plan view of the ground release device illustrated in FIG. 2.
Figure 2:
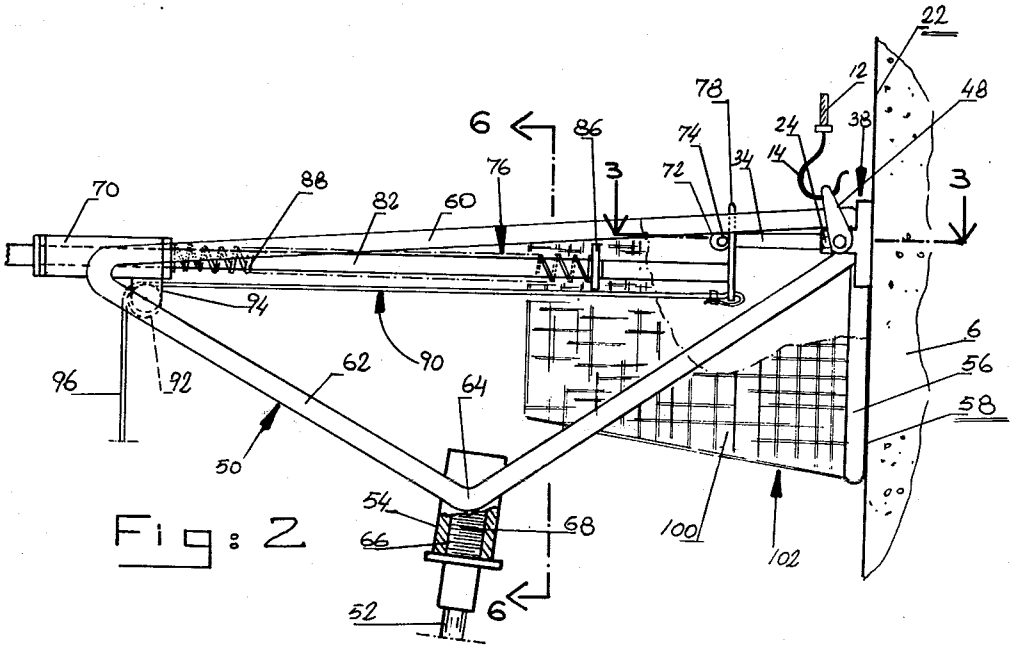
FIG. 2 is an enlarged, fragmentary side elevational view with parts broken away, showing the positioning of the ground release device of the present invention for removal of a lifting device from an erected tilt-up panel.

Referring now to FIG. 3, the construction and operation of one of the inserts embedded in tilt-up panel 6 is described in greater detail. It comprises a nut member 18 having an internally threaded opening 20 which is flush with an exterior side 22 of panel 6 and into which a split bolt 24 is secured. The nut member 10 may be constructed of a plurality of closely spaced turns of a heavy wire or rod 26. A plurality of anchoring arms 28 are secured, e.g., welded to the exterior of the wound wire defining the nut member to securely embed and secure insert 10 to the panel. Inserts are positioned at the desired locations before the panel is poured and a plug (not shown) in inserted into each threaded opening 20 to prevent wet concrete from entering and contaminating or closing the opening.

Split bolt 24 is defined by two segments 30 which have an exterior thread 32 complementary to the internal thread in nut member 18 and a wedge 34. Thus, when the nut member is constructed of wound wire the bolt segments have a thread with a generally semi-circular cross-section. The bolt segments have an insufficient width to fully fill the space of insert opening 20 so that they can be collapsed and axially inserted. When wedge 34 is inserted between the segments they are spread apart and engage the exterior thread of the bolt with the interior thread of the insert. The wedge is an elongate member which has a length greater than the length of the split bolt so that a portion 36 of the wedge protrudes past the bolt.

Split bolt 24 secures a lifting device 38 to the insert. For this purpose the bolt includes an exterior bolt head 40 which is spaced from side 22 of tilt-up panel 6. The lifting device comprises a base plate 42 positioned against the building panel and a collar 44 rotatably disposed about the bolt. If desired, the base plate and the collar may be integrally constructed. Aligned shafts 46 extend radially from the sleeve and pivotally connect a U-shaped lifting ring or eye to the sleeve and, therewith to the split bolt and the insert in the tilt-up panel.

The operation of the lifting device should now be apparent. The collapsed bolt segments 30 are passed through the bore in collar 44 and axially inserted into threaded insert aperture 20 until the bolt segments bottom-out in the opening (or until bolt head 40 contacts the outer end of the collar.) Wedge 34 is now inserted between the bolt segments by moving it axially into the opening 20 in the insert until the inner end of the wedge bottoms out. The matching threads of the insert and the split bolt are now in firm engagement and prevent any axial motion of the split bolt. Thus, the lifting device 38 is securely mounted to panel insert 10 and the lifting crane hook (not shown in FIG. 3) is placed into lifting ring 48 whereupon the panel can be raised from its horizontal position into its upright installation position.

Referring now to FIGS. 1 to 6, the ground release device 16 for disengaging split bolt 24 and lifting device 38 from the fully erected and properly tilt-up panel 6 comprises a support structure 50 which can be raised overhead with an extension pole 52 releasably secured, e.g. threaded to a fitting 54 connected to the support structure as is more fully described hereinafter. In a preferred embodiment of the invention the support structure is constructed of heavy, e.g. ⅜ or ½ inch steel rod bent or welded together into a frame and defining a generally semi-circular, upwardly opening ring 56 which forms a flat end face 58 for placement against side 22 of panel 6. The frame has an elongate configuration and includes a pair of first, rearwardly (away from panel 6) spars 60 converging and a pair of similarly rearwardly extending, upwardly opening V-shaped members 62 the forward ends of which are connected to the semi-circular ring 56 and the aft ends of which are connected to horizontal spars 60, respectively. The fitting 54 connecting the extension pole 52 to the support structure is disposed between and welded to the root or base 64 of the V-shaped members 62 and has a generally downwardly oriented internally threaded aperture 66. The upper end of the extension pole has a correspondingly externally threaded end 68 which engages the threaded apertures in the fitting. A set screw (not separately shown) may be provided for securing the threaded pole end to the fitting to prevent its accidental unthreading.

An elongate, generally horizontal bearing sleeve 70 is disposed between and welded to the aft ends of spar 60 where the spars meet the aft end of the V-shaped members 62. The spars and the V-shaped members together with the interconnecting fitting 54 and sleeve 70 form a rigid support structure from which the stiff semi-circular ring 56 depends.

The separation of lifting device 38 and split bolt 24 from insert 10 primarily involves the task of pulling wedge 34 out from between the spread apart bolt segments 30 so that the latter can be collapsed and axially withdrawn from insert opening 20. For this purpose the protruding portion 36 of the wedge includes a pair of discs 72, one on each side of the wedge, and a shaft 74 or a like member extending transversely to the discs and the wedge past the former so that the protruding shaft ends can be suitably engaged and pulled in an aft direction.

This is performed by a wedge withdrawing mechanism 76 mounted to support structure 50. It comprises a release plate 78 which is oriented parallel to building panel side 22. The plate has an upwardly opening cutout 98 defined by arms 80 which are sufficiently spaced apart so that they can be positioned on each side of wedge discs 72 to engage the shaft ends 74 protruding past the disc. The release plate is secured to a horizontally disposed square shaft 82 which extends through a square aperture in bearing sleeve 70 which allows the shaft to linearly reciprocate parallel to the axis of split bolt 24. The aft end of the shaft protrudes past the bearing sleeve and a nut 84 threaded onto the shaft limits the travel of the shaft in a forward direction, that is towards building panel 6. The travel limit is adjusted so that the distance between flat face 58 of the semi-circular ring 56 and the rearwardly facing side of release plate 78 is slightly less than the distance between panel face 22 and transverse shaft 74 in the protruding wedge portion 36. A flange 86 is secured to a forward portion of the square shaft and a helical compression spring 88 disposed between the forward end of bearing sleeve 70 and the flange biases the square shaft and the release plate 78 towards the building panel to the limit defined by stop nut 84.

The provision of a square shaft engaged by a correspondingly shaped opening in the bearing sleeve prevents rotational shaft movements and assures that release plate cutout 98 always faces upwardly.

An end of a cable 90 is conventionally secured to release plate 78 by looping the cable through an aperture in the plate. The cable runs rearwardly from the release plate and over a pulley 92 rotatable between a pair of mounting brackets 94 so that a remainder 96 of the cable depends to within the reach of the workman positioned on the ground. When the workman pulls on the cable release plate 78 together with square shaft 82 are pulled rearwardly and spring 88 is correspondingly compressed. Release of the cable by the workman permits the spring to return the square shaft and the release plate to their original position.

The operation of ground release 16 should now be apparent. A lifting device 38 together with its split bolt 24 are removed from adjacent the top of an erected tilt-up panel 6 by an operator positioned on the ground adjacent the panel by grasping the extension pole 52 and raising the ground release until it is at the approximate elevation of the lifting device. The operator now contacts panel side 22 with flat face 58 of the semi-circular ring 56 to steady the release at an elevation slightly below the lifting device. The contact between the flat ring face and the panel side further aligns square shaft 82 (and therewith the travel path of release plate 78) perpendicular to the panel and parallel to split bolt 24.

The operator now horizontally aligns the cutout 98 in release plate 78 with split bolt 24 and thereafter he pushes up on the extension pole until the protruding wedge portion 36 rests in the cutout. This position of the release plate is illustrated in FIG. 3.

The ground release device 16 is now ready to remove wedge 34. This is done by pulling on the vertical cable portion 96 to retract the release plate and linearly withdraw the wedge until it clears the split bolt segments 30 so that the latter can be collapsed and linearly withdrawn from the threaded insert opening 20.

To enable the withdrawl of the split bolt segments 30 with ground release device 16 the split bolt and ground release are constructed so that they are interconnected by a transverse pin secured to the bolt segments and permitting the bolt segments to be collapsed towards each other. This pin also engages a longitudinally extending slot in the wedge so that the continued withdrawal of the wedge after the slot end engages the pin causes the withdrawal of the bolt segments from the insert opening. This construction of a split bolt is fully set forth in the above referenced U.S. patent and is therefore neither shown nor further described herein. However, it should be noted that this construction of the bolt requires an additional linear travel of the release plate 78 over a length at least equal to the depth to which the split bolt segments are disposed in the insert opening.

Once the split bolt is fully withdrawn from the opening the bolt as well as lifting device 38 are free and can be raised with crane hook 14 to pick up the next panel. To prevent hardware, such as bolt segments 30, wedge 34 and/or lifting device 38 (or any part thereof) from falling and posing a safety hazard in the event they become accidentally engaged from each other or from the crane hook, a safety net such as a wire mesh 100 is secured, e.g. welded to the forward portion of support structure 50 to form a generally semi-cylindrical basket 102 which underlies all portions of the release mechanism and the split bolt, wedge and lifting device during the release operation. Any objects falling are caught in the basket and can thereafter by safely lowered with the ground release device. The basket further defines a relatively smooth surface to prevent any part of the bolt, the wedge or the lifting device from entangling with relatively narrow and/or sharply curved members of support structure 50 while permitting the operator to view the release operation through openings in the mesh.

Other objects and advantages of the invention will be apparent from the following description, the accompanying drawings and the appended claims.

What is claimed is:

1. A method for erecting a tilt-up building panel from a generally horizontal position into a generally vertical position comprising the steps of anchoring an insert in the panel, the insert including a threaded aperture communicating with the exterior and having an axis generally perpendicular to the panel, providing a split bolt defined by a plurality of cooperating bolt segments having an exterior thread complementary to the threaded aperture, the split bolt being formed so that it can be axially inserted into the aperture when the segments are proximate to each other, inserting wedge means between the bolt segments to spread the segments and engage them with the threaded aperture, thereby locking the bolt to the insert, raising the panel by engaging the bolt and lifting it until the panel is in its upright position, fixing the panel in its upright position, and withdrawing the bolt from the ground by positioning a linearly reciprocable release member in substantial alignment with the bolt, said positioning being performed by raising the release member from about ground level to the level of the insert by mounting it to an extension and raising the extension into an upright position until the release member is aligned with the insert, engaging the wedge means with the release member and operating the release member from the ground to move it away from the panel to thereby move the wedge means out of its engagement with the bolt segments, whereby the bolt segments can be collapsed and removed from the threaded aperture without requiring the operator to climb up on the panel.

2. In a method for separating a tilt-up building panel lifting device from the upright panel wherein the lifting device is above the reach of workmen positioned on the ground, the lifting device having a collapsible, exteriorly threaded bolt engageable with a complementary insert anchored in the wall, the bolt being defined by a plurality of axially extending bolt segments and an axially reciprocable spreader designed to move the segments in a generally radial direction into threaded engagement with the insert, the improvement to the step of removing the collapsible bolt by first axially withdrawing the sections comprising the steps of:

providing a support structure defining a flat face for placement against the panel, and a linearly reciprocable member mounted to the support structure, raising the support structure with an extension and substantially aligning the reciprocating member, actuating the reciprocating member from the ground while the member is aligned with the spreader to thereby linearly move the spreader and withdraw the spreader, collapsing the bolt segments, and withdrawing the collapsed bolt segments from the aperture to free them for re-use.

3. A method according to claim 2 wherein the support structure includes cable means secured to the reciprocating member and means guiding a portion of the cable means substantially parallel to the reciprocating path of the member and permitting a remainder of the cable means to hang gravitationally to adjacent the ground, and wherein the step of actuating the reciprocating member comprises the step of grasping the cable member adjacent the ground and pulling on the cable to thereby move the reciprocating member.

4. A method according to claim 3 including the step of resiliently urging the reciprocating member towards the face of the support.

5. A method according to claim 2 wherein the spreader engages the bolt segments over substantially the full length of the segments, and wherein the step of actuating the reciprocating member comprises the step of moving the member a distance equal to at least about the length of the segments.

6. A method according to claim 5 wherein the spreader and the segments are interconnected so that the linear movement of the spreader causes a corresponding linear movement of the bolt segments after the reciprocating member has been moved a distance about equal to the length of the segments, and wherein the step of withdrawing the bolt segments comprises the step of continuing the linear movement of the reciprocating member after it has been moved a distance about equal to the length of the bolt segment and after the bolt segments have been collapsed to thereby withdraw the bolt segments from the apertures with the reciprocating member.

7. A method according to claim 2 including the step of contacting the upright panel with the flat face of the support structure, aligning the reciprocating member in a generally horizontal direction with the bolt and the spreader, and thereafter engaging the spreader with the member by pushing the support structure upwardly in a generally vertical direction.

* * * * *